US009847845B2

(12) United States Patent
Patel et al.

(10) Patent No.: US 9,847,845 B2
(45) Date of Patent: Dec. 19, 2017

(54) SYSTEM AND METHOD FOR PROVIDING ADDITIONAL CONTENT TO A PROGRAM STREAM

(75) Inventors: Neil Patel, Pasadena, CA (US); Gary Todd Masilko, South Pasadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 950 days.

(21) Appl. No.: 11/869,042

(22) Filed: Oct. 9, 2007

(65) Prior Publication Data

US 2009/0094648 A1 Apr. 9, 2009

(51) Int. Cl.
*H04H 60/51* (2008.01)
*H04H 20/28* (2008.01)

(52) U.S. Cl.
CPC ..... *H04H 60/51* (2013.01); *H04H 20/28* (2013.01)

(58) Field of Classification Search
USPC ..... 725/135, 138, 62, 32, 35, 48, 152
See application file for complete search history.

(56) References Cited

U.S. PATENT DOCUMENTS

| | | | | |
|---|---|---|---|---|
| 6,324,694 | B1 * | 11/2001 | Watts et al. | 725/32 |
| 7,376,414 | B2 * | 5/2008 | Engstrom | 455/414.3 |
| 7,720,432 | B1 * | 5/2010 | Colby et al. | 455/3.02 |
| 7,725,362 | B2 * | 5/2010 | Weathers, Jr. | 705/26.8 |
| 7,900,229 | B2 * | 3/2011 | Dureau | 725/46 |
| 2002/0169540 | A1 * | 11/2002 | Engstrom | 701/200 |
| 2003/0135608 | A1 | 7/2003 | Bodin et al. | |
| 2004/0039796 | A1 * | 2/2004 | Watkins | 709/218 |
| 2007/0169164 | A1 * | 7/2007 | Marilly et al. | 725/135 |
| 2008/0182588 | A1 * | 7/2008 | Aaron | 455/456.3 |
| 2008/0271072 | A1 * | 10/2008 | Rothschild et al. | 725/35 |

FOREIGN PATENT DOCUMENTS

EP WO2004015896 A1 2/2004

* cited by examiner

*Primary Examiner* — Nathan Flynn
*Assistant Examiner* — Christine Kurien
(74) *Attorney, Agent, or Firm* — Farjami & Farjami LLP

(57) ABSTRACT

A system for providing additional content to a program stream includes a primary program stream, additional content that is related to the primary program stream, and a server for associating the additional content with the primary program stream based on a location of a portable communication device.

20 Claims, 7 Drawing Sheets

SYSTEM AND METHOD FOR PROVIDING ADDITIONAL CONTENT TO A PROGRAM STREAM

BACKGROUND

The use of portable handheld communications devices has proliferated throughout the world to the extent that there are individuals that use such devices as their primary communication platform. These devices include, for example, a portable cellular-type telephone, a personal digital assistant (PDA), a mobile computing device, and devices that incorporate telephone and PDA functionality. In addition, there is becoming available a type of portable device and associated services that enable a user to view video content. A non-limiting example of a standard that allows the delivery of video content to a portable communication device is the digital video broadcast for handheld devices (DVB-H) communication standard. However, many other video delivery protocols are becoming available, such as ones using Wi-Fi, WiMAX and Internet Protocol (IP) standards.

One of the attributes of such portable communication devices is that a service provider can determine the location of the portable communication device with reasonable accuracy. For example, cellular tower triangulation using cellular communication towers allows a service provider a modest level of resolution with respect to locating a particular portable communication device and global positioning system (GPS)-based locating systems allow a service provider a higher level of resolution with respect to locating a particular portable communication device.

The users of such portable communication devices are a source of potential advertising revenue for service providers and companies wishing to reach such users with advertising material. However, a challenge in providing advertising to such users is that much of the advertising material is specific to a particular location.

Therefore, it would be desirable to have a way to reach such users with advertising materials.

SUMMARY

Embodiments of the invention include a system for providing additional content to a program stream, comprising a primary program stream, additional content that is related to the primary program stream; and a server for associating the additional content with the primary program stream based on a location of a portable communication device.

Other embodiments are also provided. Other systems, methods, features, and advantages of the invention will be or become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE FIGURES

The invention can be better understood with reference to the following figures. The components within the figures are not necessarily to scale, emphasis instead being placed upon clearly illustrating the principles of the invention. Moreover, in the figures, like reference numerals designate corresponding parts throughout the different views.

DETAILED DESCRIPTION

Figure 1:
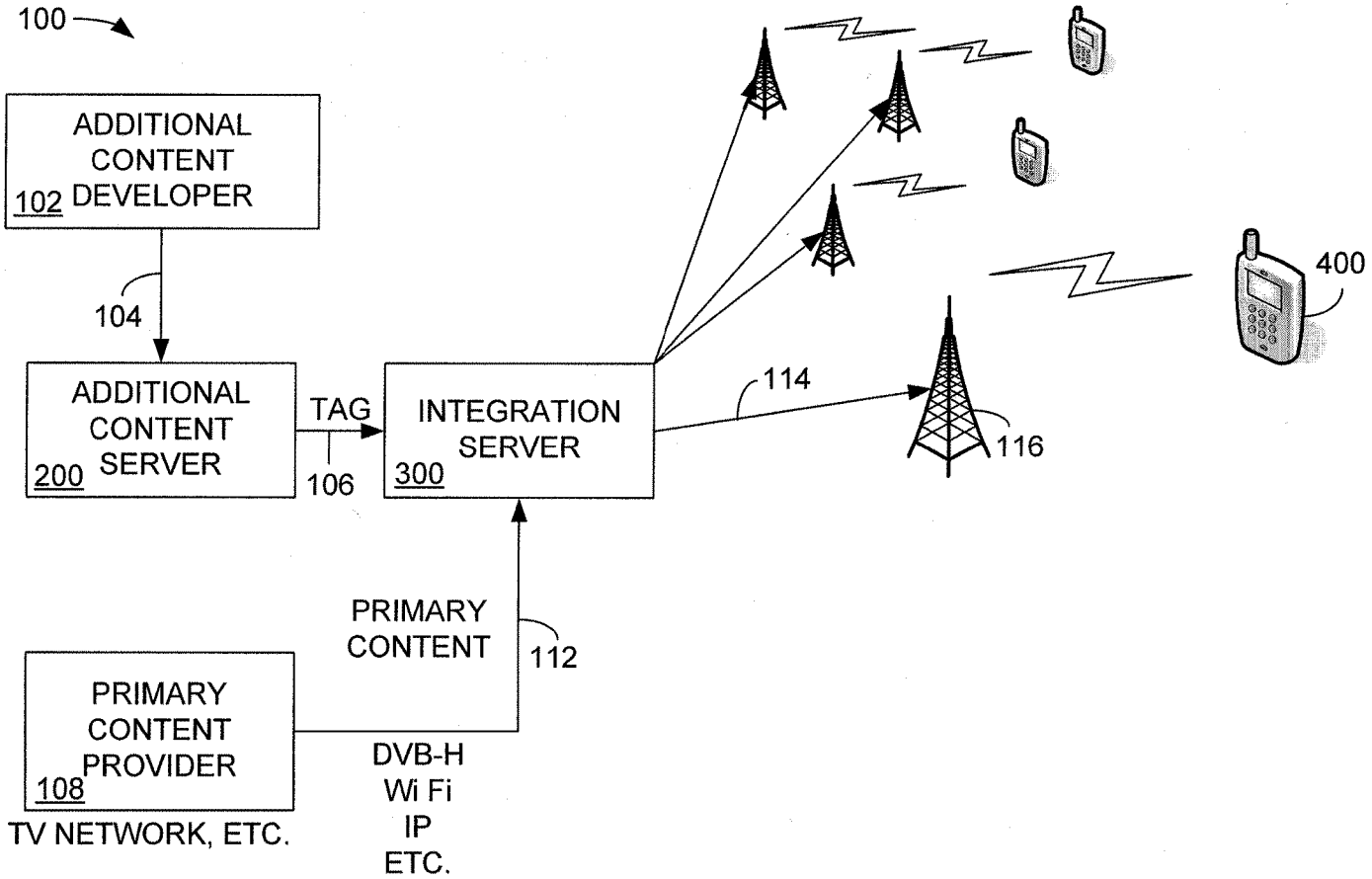
FIG. 1 is a schematic diagram illustrating an additional content system in accordance with an embodiment of the system and method for providing additional content to a program stream.

The system and method for providing additional content to a program stream will be described in the context of providing location-based targeted advertising to a user of a portable communication device. However, the system and method for providing additional content to a program stream can be used to associate any additional content with primary content.

The system and method for providing additional content to a program stream can be implemented in hardware, software, or a combination of hardware and software. When implemented in hardware, the system and method for providing additional content to a program stream can be implemented using specialized hardware elements and logic. When the system and method providing additional content to a program stream is implemented in software, the software can be used to control the various components in a system and network associated with the program. The software can be stored in a memory and executed by a suitable instruction execution system (microprocessor). The hardware implementation of the system and method providing additional content to a program stream can include any or a combination of the following technologies, which are all well known in the art: discrete electronic components, a discrete logic circuit(s) having logic gates for implementing logic functions upon data signals, an application specific integrated circuit having appropriate logic gates, a programmable gate array(s) (PGA), a field programmable gate array (FPGA), etc.

The software for the system and method for providing additional content to a program stream comprises an ordered listing of executable instructions for implementing logical functions, and can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection (electronic) having one or more wires, a portable computer diskette (magnetic), a random access memory (RAM), a read-only memory (ROM), an erasable programmable read-only memory (EPROM or Flash memory) (magnetic), an optical fiber (optical), and a portable compact disc read-only memory (CDROM) (optical). Note that the computer-readable medium could even be paper or another suitable medium upon which the program is printed, as the program can be electronically captured, via for instance, optical scanning of the paper or other medium, then compiled, interpreted or otherwise processed in a suitable manner if necessary, and then stored in a computer memory.

FIG. 1 is a schematic diagram illustrating an additional content system 100 in accordance with an embodiment of the system and method for providing additional content to a program stream. The additional content system 100 includes an additional content developer 102 coupled to an additional content server 200 via communication link 104. In an embodiment, the additional content developer 102 can be, for example but not limited to, a client, a company, an advertising agency for a client, or any entity that wishes to provide location specific advertising to a user of a portable communication device. In an embodiment, the additional content developer 102 is an advertising agency that has developed regional and or location-specific advertisements, referred to as "ads" that are to be associated with a primary content stream and delivered to a portable communication device based on the geographic location of the portable communication device.

The additional content provided by the additional content developer 102 can also include games, game shows, sports scores, news tickers, maps with local market store locations, or any other additional content that can be associated with a video data stream.

The additional content server 200 can be a server computer, including related software, that can be located at a broadcaster's location, or which can be located elsewhere. The additional content server 200 receives the additional content via communication link 104 and identifies the additional content based on one or more rules. Examples of rules used to identify the additional content can include the particular region of the country, city, etc., to which the additional content is targeted, a particular user demographic to which the additional content is targeted, or a particular relevant time frame, etc.

In an embodiment, the additional content server 200 applies metadata, which can also be referred to as a "tag," to the additional content so that the additional content can be uniquely and individually identified and associated with primary content. In this manner, the additional content can be geographically tailored to a particular user in a particular region of the country. The "tag" described above may be used to trigger other associated content, such as a graphic "call to action" linking to interactive material, such as graphic or video content, electronic coupons, scanable barcodes associated with an add campaign, etc. The additional content is provided to an integration server 300 via communication link 106. The integration server 300 will be described in greater detail below.

The additional content system 100 also includes a primary content provider 108. The primary content provider 108 can be, for example, a television network studio producing video content, or can be any other producer of video content. In an embodiment of the system and method for providing additional content to a program stream, the primary content provider 108 is a television network studio providing video content, or can be any other producer or supplier of video content. In an embodiment, the primary content can be provided using the digital video broadcast for handheld device (DVB-H) protocol or Media FLO and is referred to as a primary content stream. The primary content is delivered to an integration server 300 via communication link 112. It should be mentioned that any video content according to any standard can be provided by the primary content provider 108.

The integration server 300 associates the primary content and the additional content, so that the additional content can be provided with the primary content to a user as part of the primary content stream, as will be described below. In an alternative embodiment, the additional content is not integrated into the primary content stream, but is instead associated with the primary content using metadata. In this manner, the additional content is typically provided to a portable communication device as a unique file separate from the primary content. This additional content may be streamed alongside the primary content, or cached in a directory of assets linked to the broadcast stream and triggered via metadata tags.

The additional content system 100 also includes a network provider, also sometimes referred to as a service provider, illustrated using provider tower 116. The provider tower 116 is coupled to the integration server 300 via communication link 114. Although not individually described, a plurality of provider towers can be coupled to the integration server 300. In an embodiment, the network provider can be a mobile broadcast provider that can be associated with a cellular communication carrier. In accordance with an aspect of the system and method for providing additional content to a program stream, the provider tower 116 provides tower location data to the integration server 300. A portable communication device 400 bi-directionally communicates with the provider tower 116 using a radio frequency (RF) communication link, as known to those skilled in the art. In an embodiment, additional content may be multicast to all available devices. An example may be a short mobile specific transition message, sometimes referred to as a "bumper," added to the end of a broadcast ad and sent to all users in a specific market area.

In accordance with an embodiment of the system and method for providing additional content to a program stream, the location of the portable communication device 400 can be established in a number of ways. For example, the general location of the portable communication device 400 can be established using the tower location data associated with the provider tower 116 that is communicating with the portable communication device 400. In this example, this will roughly locate the portable communication device 400 as being within the service area of the provider tower 116.

In accordance with an alternative embodiment of the system and method for providing additional content to a program stream, cellular triangulation can be used to more precisely determine the geographic location of the portable communication device 400. In yet another alternative embodiment of the system and method for providing additional content to a program stream, if equipped with global positioning system (GPS) technology, the portable communication device 400 can be precisely located.

As will be described below, the rough tower location data can be used by the integration server 300 to deliver location specific additional content to the portable communication device 400.

Figure 2:
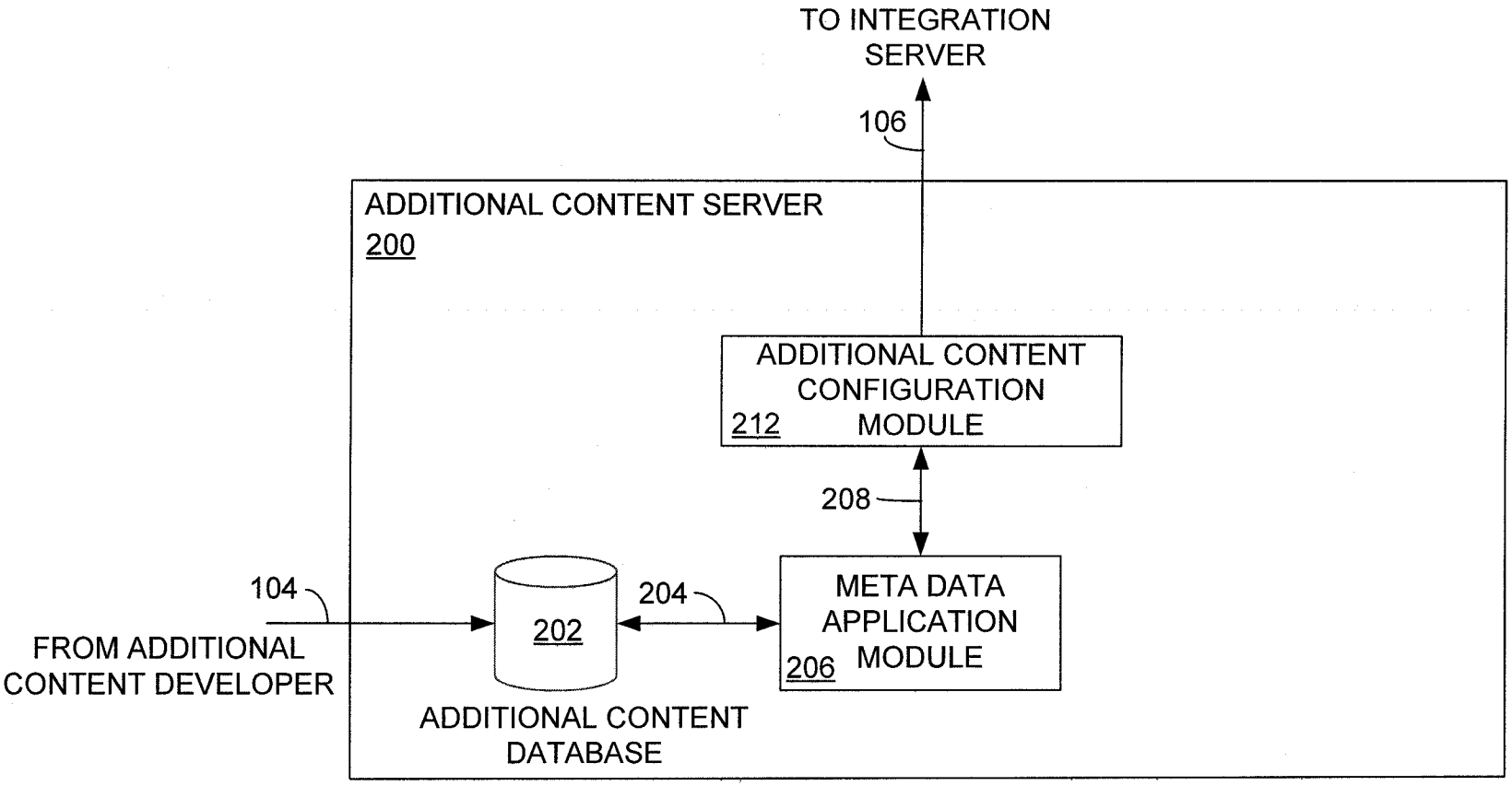
FIG. 2 is a block diagram illustrating the additional content server of FIG. 1.

FIG. 2 is a block diagram illustrating the additional content server 200 of FIG. 1. In an embodiment, the additional content server 200 includes an additional content database 202 that receives and stores the additional content from the additional content developer 102 (FIG. 1) via communication link 104. The additional content database 202 is bi-directionally coupled to a metadata application module 206. The metadata application module 206 applies metadata, also referred to as tag information, to the additional content within the additional content database 202. The metadata applied to the additional content uniquely identifies the additional content by location, association with primary content, and other information as desired. Metadata as described herein, can take several forms including "header" information written into the media file. Alternatively, a metadata application module can create a separate ASCII file that lists both primary content (i.e. a video stream, as well as additional content associated with the video stream (i.e. a "coupon" graphic). The ASCII file may not be literally "attached" to the video stream, but playback software on the portable device could read the ASCII file for instructions on which additional content to display and when to do so.

The additional content server 200 also includes an additional content configuration module 212. The additional content configuration module 212 receives the additional content including the metadata via communication link 208 and configures the information so that it can be provided to the integration server 300 (FIG. 1) via communication link 106. The additional content configuration module 212 associates the additional content with the primary content, so that the appropriate additional content can be associated with and provided with the desired primary content. Although illustrated as a separate element, the additional content configuration module may also be implemented as a tool that is integrated into an existing media asset management device of video editing software.

Figure 3:
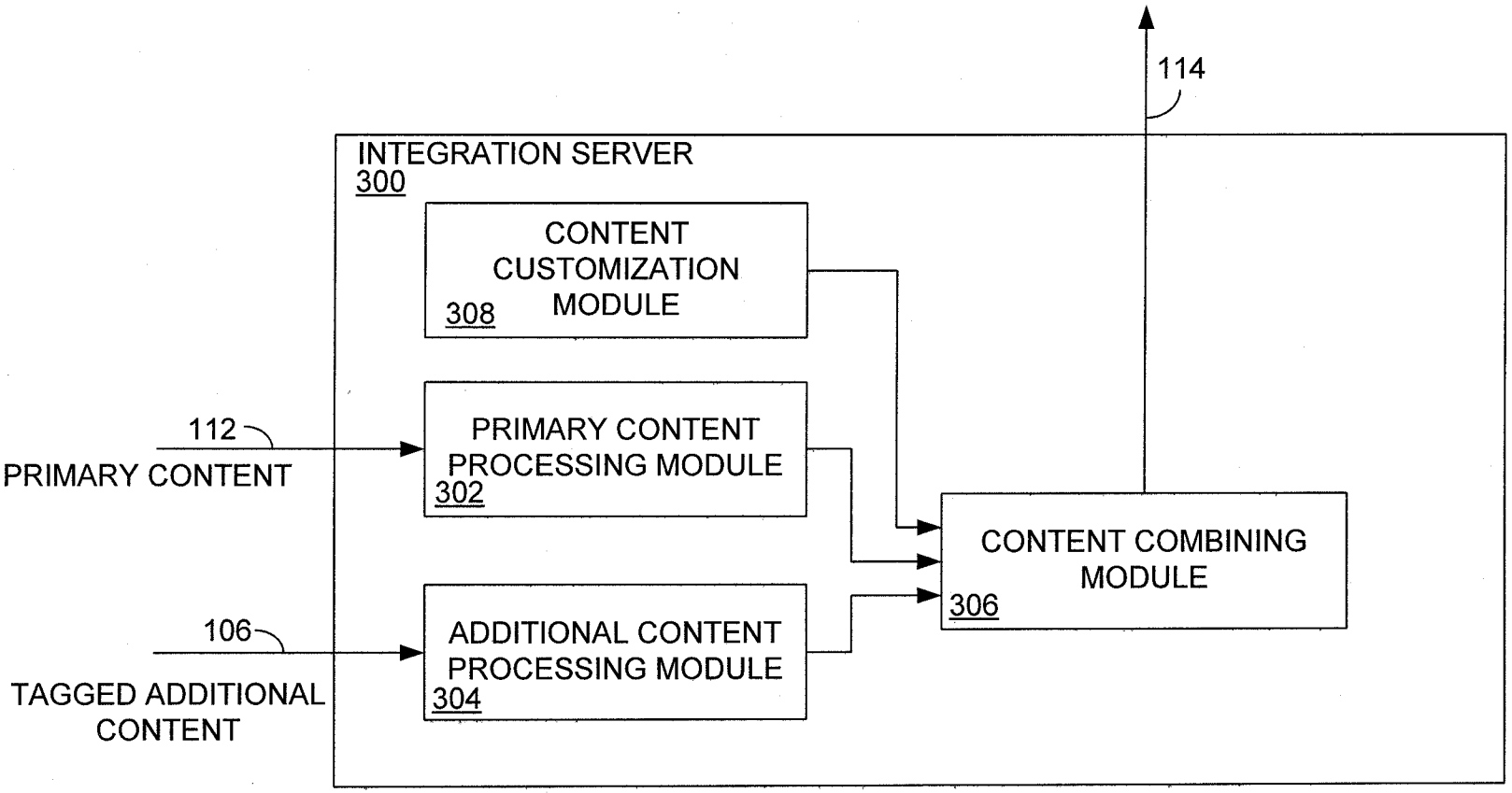
FIG. 3 is a block diagram illustrating the integration server of FIG. 1.

FIG. 3 is a block diagram illustrating the integration server 300 of FIG. 1. The integration server 300 includes a primary content processing module 302 and an additional content processing module 304. The primary content processing module 302 can be a software application that receives the primary content via communication link 112 and provides the primary content to a content combining module 306. Similarly, the additional content processing module 304 can be a software application that receives the metadata tagged additional content via communication link 106 and provides the metadata tagged to additional content to the content combining module 306.

The integration server 300 also includes a content customization module 308. The content customization module 308 can be a software application that customizes the additional content by a number of different rules that include, for example, geographic location, primary content, user demographic, interest groups, specified times, etc.

Figure 4:
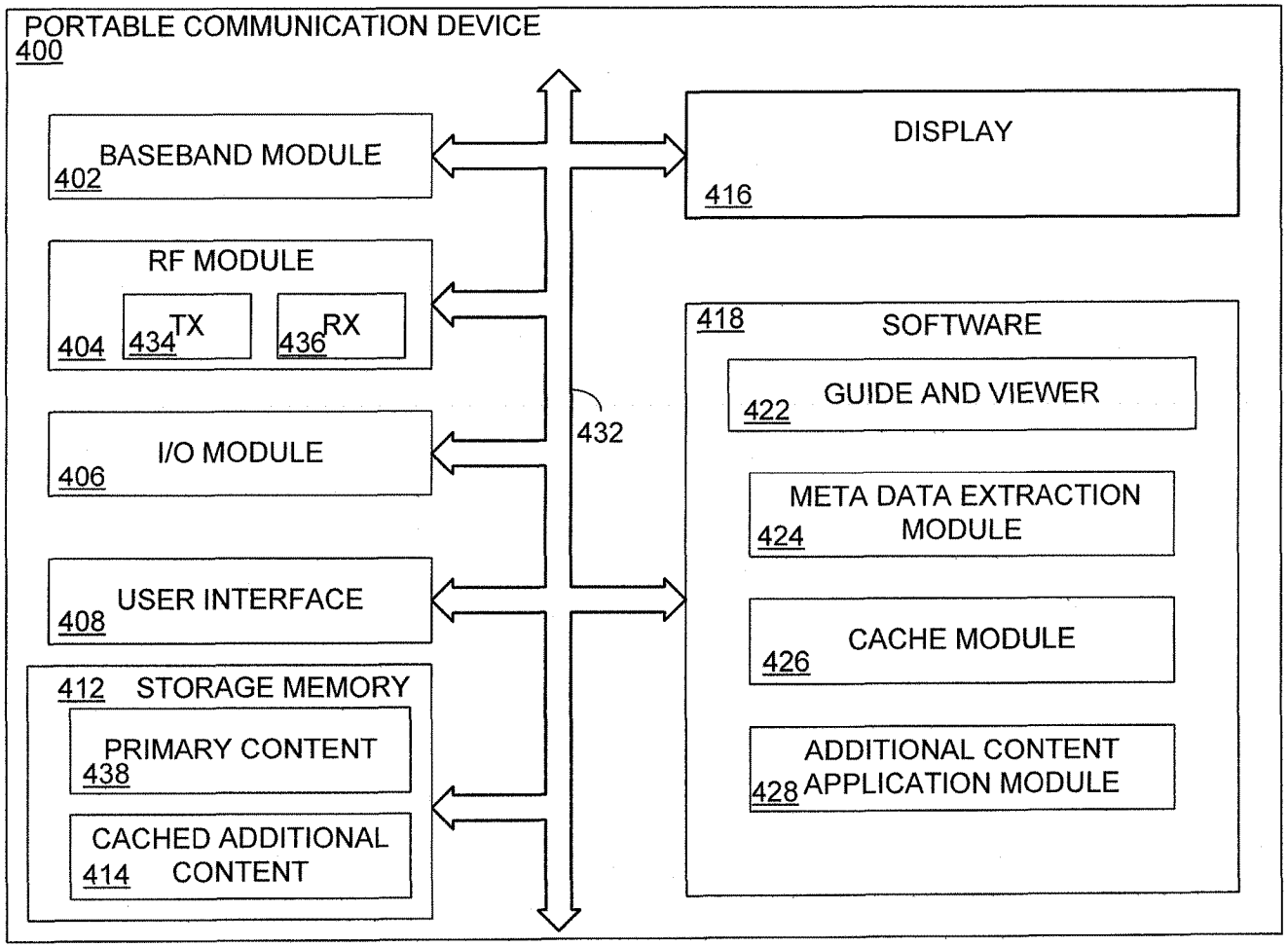
FIG. 4 is a block diagram illustrating a simplified portable communication device in accordance with an embodiment of the system and method for providing additional content to a program stream.

FIG. 4 is a block diagram illustrating a simplified portable communication device 400 in accordance with an embodiment of the system and method for providing additional content to a program stream. Only the basic elements of a portable communication device will be illustrated as the operation of such devices is understood by those skilled in the art. The portable communication device 400 includes a baseband module 402, a radio frequency (RF) module 404, and input output (I/O) module 406, a user interface 408, a storage memory 412, a display 416, and software 418 coupled via a logical and physical communication bus 432.

The RF module 404 generally contains a transmitter 434 and a receiver 436, as known in the art. The baseband module 402 and the RF module 404 also contain analog, digital and mixed signal circuitry and software that allow the portable communication device 400 to transmit and receive voice and data signals, and will not be described in detail as they would be understood by one having ordinary skill in the art. The I/O module 406 includes the interfaces that allow the portable communication device 400 to send, receive and interpret information. Depending on the type of portable communication device, the user interface 408 may include one or more of the following: a microphone, a speaker, a keyboard, a touchpad, a mouse, a trackball, a pointing device, and any other user input and output devices. The storage memory 412 includes the memory used for the normal operation of the portable communication device 400 and also includes a location at which to store the primary content 438 and a location at which to store the cached additional content 414. The cached additional content 414 represents any additional content that is delivered to the portable communication device 400 in accordance with the embodiments described herein. The additional content can be delivered to the portable communication device attached to or separate from the primary content.

The portable communication device 400 also includes a software element 418. The software element 418 includes one or more software elements in accordance with the embodiments of a system and method for providing additional content to a program stream, as described herein. The software elements to be described below are generally located on the portable communication device 400. However, elements of the software described below may also be present on the integration server 300, or distributed across the elements of the additional content system 100.

The software includes guide and viewer software 422, metadata extraction module 424, cache module 426 and additional content application module 428. The guide and viewer software 422 includes the software that the portable communication device 400 uses to display a program guide and viewing options to a user of the portable communication device 400. In this embodiment, the guide and viewer software 422 interacts with the I/O module 406 and the display 416.

The metadata extraction module 424 receives the metadata associated with the additional content and extracts and interprets the metadata so that the additional content can be identified. The additional content can be stored in the storage memory 412 as cached additional content 414. The cache module 426 interacts with the storage memory 412 to store the cached additional content 414.

The additional content application module 428 determines when additional content is available in the primary content stream. This may be done checking the broadcast stream for a "trigger" by checking a separate, time synchronized stream over an Internet Protocol (IP) data communication link, or by other methods. In an embodiment, when the additional content application module 428 determines that additional content is available in the primary content stream, the additional content application module 428 generates an indication that is presented to a user. The indication can be a button or other visual or audible indicator that is presented on the display 416 or through the user interface 408. In this example, the user indicates the desire to view the additional content by actuating a button.

The additional content application module 428 determines when the additional content is desired by the user of the portable communication device 400. When the additional content application module 428 determines that the additional content is desired by the user, the additional content application module 428 provides the cached additional content 414 to a user via the display 416.

Figure 5B:
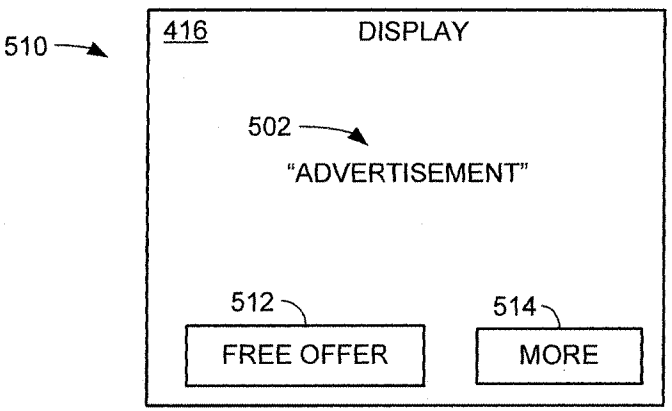
FIGS. 5A through 5C are graphical examples of the operation of an embodiment of the portable communication device of FIG. 4.
Figure 5A:
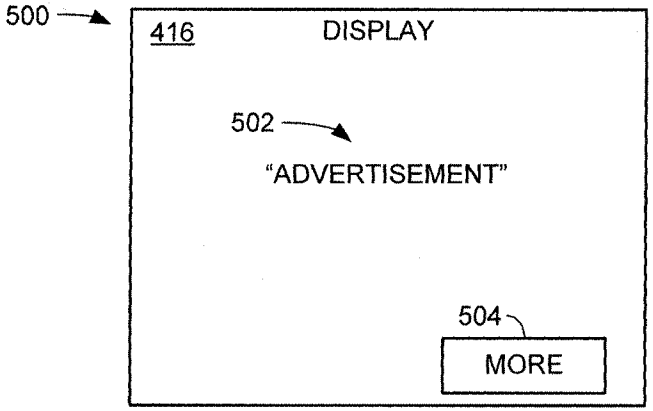
Figure 5C:
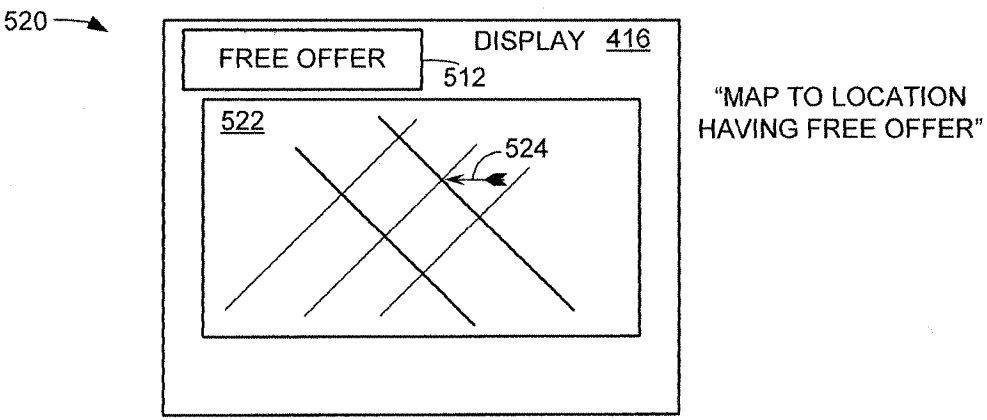

FIGS. 5A through 5C are graphical examples of the operation of an embodiment of the portable communication device 400 of FIG. 4. In FIG. 5A, the display 416 is displaying an advertisement 502 to a user of the portable communication device 400. The advertisement 502 may be part of the primary content. In this example, additional content associated with the advertisement 502 is available to the user. The additional content application module 428 presents a button 504 or other activation means on the display 416. A user viewing the advertisement 502 observes the button 504 with the word "more." The button 504 indicates to a user that additional content is available as associated with the advertisement 502.

In FIG. 5B, the user has activated the button 504 using, for example, a hotkey, a software defined softkey, a touch screen, or other indication mechanism on the portable communication device 400. After the button 504 is actuated, in addition to the advertisement 502, additional content 512 appears on the display 416. In this example, the additional content 512 is a "free offer" that is related to the advertisement 502, or that can be different from the advertisement 502. When the button 504 is actuated, the additional content application module 428 retrieves the cached additional content 414 and presents the additional content on the display 416. Because additional content is still available in this example, a button 514 appears with the legend "more." The button 514 indicates that yet additional content is available.

In FIG. 5C, the user has actuated the button 514 and is presented with a map 522 showing the geographic location of the vendor or service provider having the "free offer" presented in FIG. 5B. In this example, the additional content 512 is still displayed above the map 522. Alternatively, the embodiments described in FIGS. 5A, 5B and 5C may be independently implemented, and not dependent upon the other. For example, in FIG. 5C, the map 522 may be presented to a user and as the user moves, an offer may be presented to the user based on the users location, as the user is, for example, walking.

In this manner, because the geographic location of the portable communication device 400 is known with at least a reasonable degree of accuracy, a user of the portable communication device 400 can be provided with targeted additional content, in this case a targeted advertisement, based on at least the geographic location of the portable communication device 400. The combination of the integration server 300, and the ability of the system to locate the portable communication device 400, makes such targeted additional content feasible.

Figure 6:
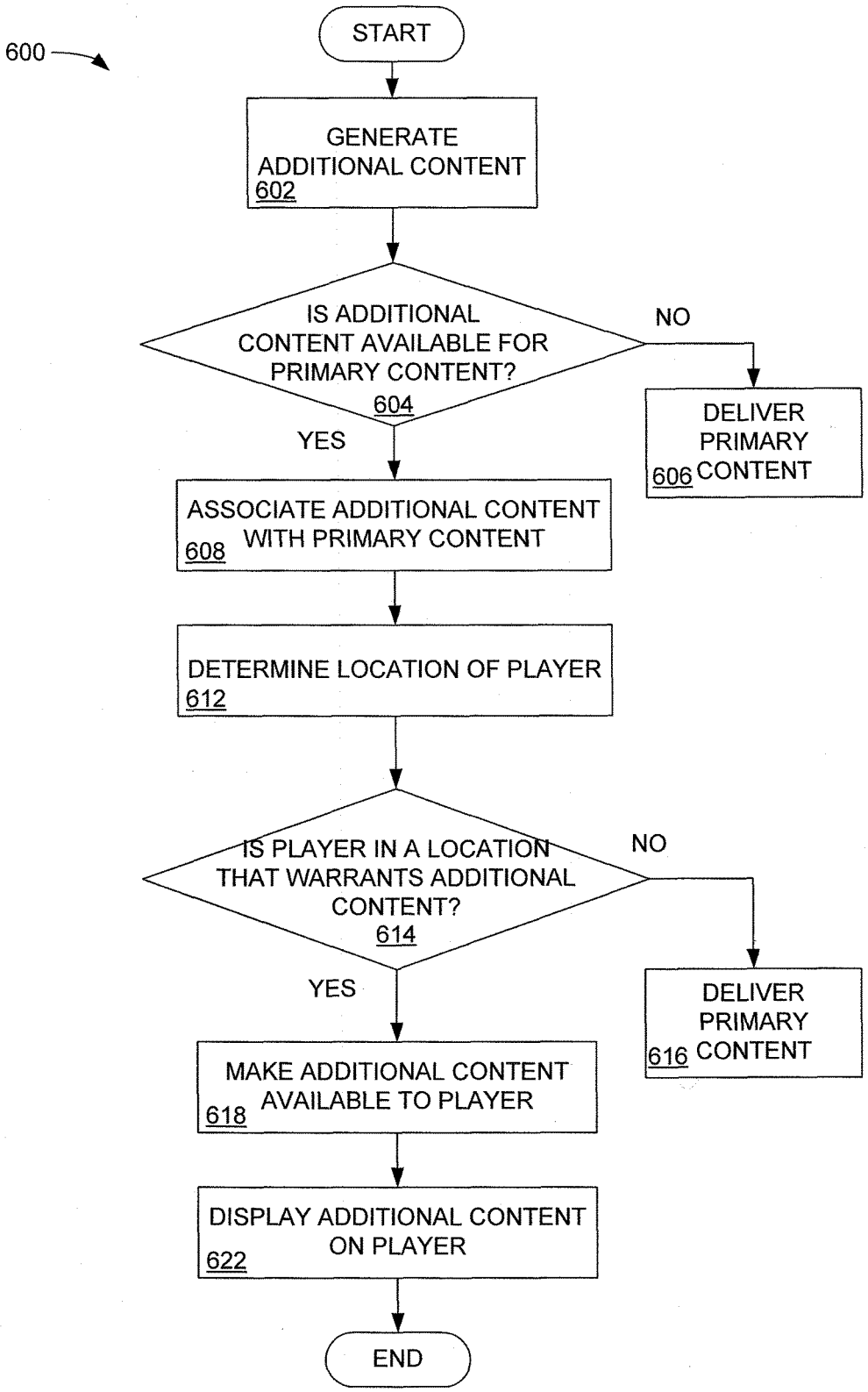
FIG. 6 is a flow chart describing the operation of an embodiment of the system and method for providing additional content to a program stream.

FIG. 6 is a flow chart describing the operation of an embodiment of the system and method for providing additional content to a program stream. The blocks in the flow chart shown in FIGS. 6 and 7 can be performed in or out of the order shown by the elements described above, or can be performed by different elements than the elements previously described. In block 602, additional content is generated by the additional content developer 102 (FIG. 1). In block 604, it is determined whether additional content is available for the primary content. If additional content is not available for the primary content, then, in block 606, the primary content is delivered in a normal manner.

If however, in block 604, it is determined that additional content is available for the primary content, then, in block 608, the additional content is associated with the primary content. The integration server 300 (FIG. 1) can be used to associate the additional content with the primary content, as described above.

In block 612, the location of the portable communication device 400 is determined. The location of the portable communication device 400 can be determined using, for example, the location of the provider tower 116 with which the portable communication device 400 is communicating, cellular triangulation using a number of provider towers 116 to determine the location of the portable communication device 400, or GPS data received from the portable communication device 400.

In block 614 it is determined whether the portable communication device 400 is in a location that warrants the additional content. If, in block 614 it is determined that the portable communication device is not in a location that warrants additional content, then, in block 616, the primary content is delivered to the portable communication device 400. If, in block 614 it is determined that the portable communication device is in a location that warrants additional content, then, in block 618, the additional content is delivered to the portable communication device 400 and stored therein as described above. In block 622, the additional content is displayed to a user of the portable communication device 400.

Figure 7:
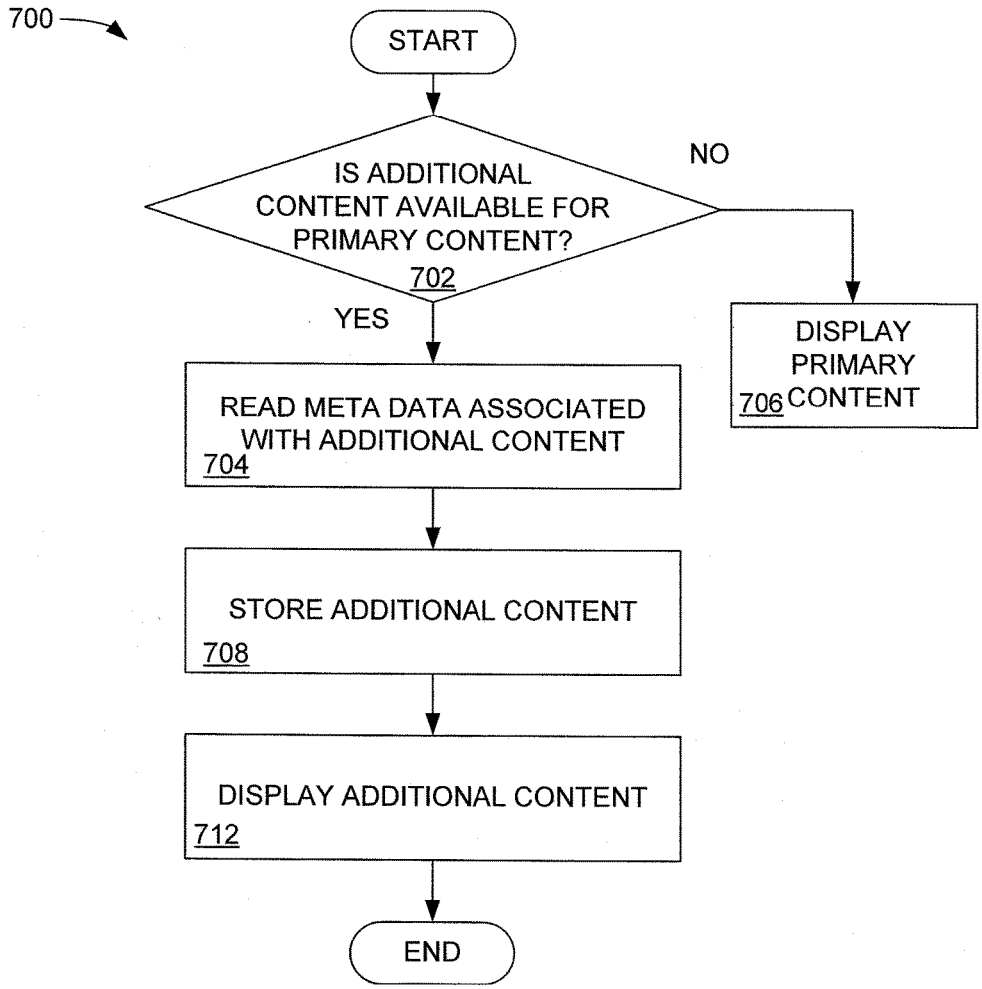
FIG. 7 is a flow chart describing the operation of an embodiment of the portable communication device of FIG. 4.

FIG. 7 is a flow chart describing the operation of an embodiment of the portable communication device 400 of FIG. 4. In block 702, it is determined whether additional content is available for primary content. If additional content is not available, then the portable communication device 400 displays the primary content in block 706. If however it is determined in block 702 that additional content is available for the primary content, then, in block 704, the metadata extraction module 424 reads the metadata associated with the additional content.

In block 708, the cache module 426 stores the additional content as cached additional content 414. In block 712, and when requested by a user, the additional content application module 428 displays the additional content to a user of the portable communication device 400.

While various embodiments of the invention have been described, it will be apparent to those of ordinary skill in the art that many more embodiments and implementations are possible that are within the scope of the invention. The system and method for providing additional content to a program stream is not limited to a specific type of additional content or to a specific type of content delivery.

What is claimed is:

1. A computer system for providing contents to a portable communication device, comprising:

a processor; and a memory including a content combining module for execution by the processor to:

receive a primary content program from a primary content provider;

receive a first additional content and a second additional content from an additional content provider, the first additional content being related to the primary content program, the first additional content comprising a first displayable location-based content and non-displayable metadata including a trigger, the second additional content comprising a second displayable location-based content related to the first additional content;

associate, in response to a real-time, dynamic location of the portable communication device, the first additional content and the second additional content with the primary content program based on the non-displayable metadata and the location of the portable communication device; and provide the first additional content, the second additional content, and the primary content program together to the portable communication device as an integrated primary content stream prior to actuating the trigger by the portable communication device, wherein the second additional content is displayed on a display of the portable communication device in response to actuating the trigger by the portable communication device.

2. The computer system of claim 1, wherein providing the integrated primary content stream to the portable communication device includes providing the integrated primary content stream to a communication network for delivery to the portable communication device.

3. The computer system of claim 1, wherein the processor further associates customization module rules with the first additional content, the second additional content, and the primary content program, wherein the customization module rules include a user demographic or a user interest group.

4. The computer system of claim 1, wherein the integrated primary content stream is delivered by a system chosen from at least one of a digital video broadcast for handheld devices (DVB-H), Wi-Fi and Interact Protocol (IP).

5. The computer system of claim 1, wherein the first additional content and the second additional content further comprise an advertisement targeted in accordance with the real-time, dynamic location of the portable communication device.

6. The computer system of claim 1, wherein the first additional content and the second additional content are displayed, on the display of the portable communication device, in response to a user request received via a user interface generated by the portable communication device on the display.

7. The computer system of claim 1, wherein the portable communication device further comprises an additional content application module configured to display the first additional content and the second additional content.

8. The computer system of claim 1, wherein before receiving the first additional content, the additional content provider applies the metadata to the first additional content.

9. The computer system of claim 1, wherein the second displayable location-based content includes a map showing a geographical location of a service provider.

10. The computer system of claim 9, wherein the map is presented based on the real-time, dynamic location of the portable communication device.

11. A method for use by a processor for providing contents to a portable communication device, comprising:

receiving, by the processor, a primary content program from a primary content provider;

receiving, by the processor, a first additional content and a second additional content from an additional content provider, the first additional content being related to the primary content program, the first additional content comprising a first displayable location-based content and non-displayable metadata including a trigger, the second additional content comprising a second displayable location-based content related to the first additional content;

associating, by the processor, in response to a real-time, dynamic location of the portable communication device, the first additional content and the second additional content with the primary content program based on the non-displayable metadata and the location of the portable communication device; and providing, by the processor, the first additional content, the second additional content, and the primary content program together to the portable communication device as an integrated primary content stream prior to actuating the trigger by the portable communication device, wherein the second additional content is displayed on a display of the portable communication device in response to actuating the trigger by the portable communication device.

12. The method of claim 11, wherein providing the integrated primary content stream to the portable communication device includes providing the integrated primary content stream to a communication network for delivery to the portable communication device.

13. The method of claim 11, wherein the associating, by the processor, further associates customization module rules with the first additional content, the second additional content, and the primary content program, wherein the customization module rules include a user demographic or a user interest group.

14. The method of claim 11, wherein the integrated primary content stream is delivered by a system chosen from at least one of a digital video broadcast for handheld devices (DVB-H), Wi-Fi and Internet Protocol (IP).

15. The method of claim 11, wherein the first additional content and the second additional content further comprise an advertisement targeted in accordance with the real-time, dynamic location of the portable communication device.

16. The method of claim 11, wherein the first additional content and the second additional content are displayed, on the display of the portable communication device, in response to a user request received via a user interface generated by the portable communication device on the display.

17. The method of claim 11, wherein the portable communication device further comprises an additional content application module configured to display the first additional content and the second additional content.

18. The method of claim 11, wherein before receiving the first additional content, the additional content provider applies the metadata to the first additional content.

19. The method of claim 11, wherein the second displayable location-based content includes a map showing a geographical location of a service provider.

20. The method of claim 19, wherein the map is presented based on the real-time, dynamic location of the portable communication device.

* * * * *